US006460392B2

(12) United States Patent
Wiens et al.

(10) Patent No.: US 6,460,392 B2
(45) Date of Patent: Oct. 8, 2002

(54) FLANGE BENDING APPARATUS

(75) Inventors: Philip V. Wiens, LaSalle (CA); Michael J. Ross, Wales Township, MI (US); Kris R. Harper, Three Springs, PA (US)

(73) Assignee: Unova IP Corp., Woodland Hills, CA (US)

( * ) Notice: Subject to any disclaimer, the term of this patent is extended or adjusted under 35 U.S.C. 154(b) by 0 days.

(21) Appl. No.: 09/796,263

(22) Filed: Feb. 28, 2001

(65) Prior Publication Data

US 2002/0116977 A1 Aug. 29, 2002

(51) Int. Cl.[7] ..... B21D 39/02
(52) U.S. Cl. ..... 72/306; 72/322; 29/243.58
(58) Field of Search ..... 72/306, 322, 386; 29/243.58, 243.57, 243.5

(56) References Cited

U.S. PATENT DOCUMENTS

| | | | | |
|---|---|---|---|---|
| 3,092,057 A | | 6/1963 | Warshilek | |
| 3,147,726 A | | 9/1964 | Tribe | |
| 3,466,661 A | | 9/1969 | Phillips | |
| 3,598,073 A | | 8/1971 | St. Denis | |
| 4,346,579 A | | 8/1982 | Takatsu | |
| 4,706,489 A | | 11/1987 | Dacey, Jr. | |
| 5,038,597 A | | 8/1991 | Dorsett | |
| 5,086,638 A | | 2/1992 | David | |
| 5,740,691 A | * | 4/1998 | Kovarovic et al. | 29/243.58 |
| 5,979,208 A | | 11/1999 | Hartley | |
| 6,035,504 A | * | 3/2000 | Gorgen | 29/243.5 |
| 6,253,439 B1 | * | 7/2001 | Niehwohner | 29/243.5 |
| 6,295,858 B1 | * | 10/2001 | Torito | 29/243.58 |

FOREIGN PATENT DOCUMENTS

JP 3-94926 * 4/1991

* cited by examiner

*Primary Examiner*—Daniel C. Crane
(74) *Attorney, Agent, or Firm*—Reising, Ethington, Barnes, Kisselle, Learman & McCulloch, PC

(57) ABSTRACT

A flange bending apparatus for bending an upstanding flange on an inside perimeter of an automotive window opening. A flanging steel drive reciprocally drives a flanging steel between retracted and extended positions on a frame. The retracted position of the first flanging steel allows a metal panel workpiece to be positioned on the frame with the flanging steel extending through an opening in the workpiece. When in the extended position the flanging steel overlies a portion of an inside perimeter of the opening. As it moves toward the extended position the flanging steel engages an inner surface of an upstanding workpiece flange that extends upward from around the inside perimeter of the workpiece opening. The flanging steel then bends the flange radially outward as the drive continues to move the steel to the extended position. The flanging steel bends the workpiece flange radially outward such that a lateral bend line is formed along the flange where no breakline was present before bending.

19 Claims, 7 Drawing Sheets

FLANGE BENDING APPARATUS

TECHNICAL FIELD

This invention relates generally to an apparatus for bending an upstanding flange along the edge of a panel.

BACKGROUND OF THE INVENTION

Flange bending apparati for pre-bending upstanding flanges are known in the art. One example of such an apparatus is disclosed in U.S. Pat. No. 5,979,208 issued Nov. 9, 1999 to Hartley and assigned to the assignee of the present invention. Hartley discloses a flange bending apparatus that including a flanging steel supported on a frame for movement between a generally radially inward retracted position and a generally radially outward extended position. In the generally radially outward position the flanging steel overlies at least a portion of an inside perimeter of an opening in two sheet metal panels that have been located in a position on the apparatus to be hemmed together along the inside perimeter. The flanging steel engages and bends downward an upstanding hem flange of one of the panels that extends upward, i.e., in a direction normal to the radial motion of the steel, from around the inside perimeter of the opening. The flanging steel bends the upstanding hem flange along a pre-existing break line or bend line. The break line that the flanging steel bends the flange along is formed in a preceding operation in which the hem flange is bent to extend perpendicularly upward from a lower one of the two panels. The flange bending apparatus of the Hartley patent includes an actuator operatively connected to the flanging steel and configured to reciprocally drive the flanging steel between the retracted and extended positions when two sheet metal door panels are supported in a position to be hemmed together. However, a flange bending apparatus constructed according to the Hartley patent is unable to bend an upstanding flange of a sheet metal panel where the flange has no pre-existing break line to facilitate and guide the bending.

SUMMARY OF THE INVENTION

A flange bending apparatus is provided for bending an upstanding flange along an inside perimeter of an opening in a panel, such as a window opening in an automotive door panel. The apparatus includes a frame configured to support a metal panel workpiece and a first flanging steel supported on the frame for movement between a generally radially inward retracted position and a generally radially outward extended position. The apparatus also includes a flanging steel drive including an actuator operatively connected to the first flanging steel and configured to reciprocally drive the first flanging steel between the retracted and extended positions. The retracted position of the first flanging steel allows a metal panel workpiece to be positioned on the frame with the flanging steel extending through an opening in the workpiece. The first flanging steel overlies a first portion of an inside perimeter of the opening when the first flanging steel is in the extended position. The first flanging steel is positioned and configured to engage an inner surface of an upper first portion of an upstanding workpiece flange that extends generally axially upwardly from around the inside perimeter of the opening in the workpiece and to bend the upper first portion of the workpiece flange radially outward when the actuator moves the first flanging steel from the retracted to the extended position.

The first flanging steel and frame are configured to bend the upper first portion of the workpiece flange radially outward such that a lateral bend line is formed along the flange where no breakline was present before bending. Therefore, a flange bending apparatus constructed according to the invention is able to bend an inside perimeter edge of a sheet metal panel where the sheet metal panel has no pre-existing break line to facilitate and guide the bending and where the edge of the sheet metal panel defines an opening in sheet metal panel.

The invention also includes a method for bending an upstanding flange along an inside perimeter of a panel, such as an automotive door panel, that defines an opening, such as a window opening, in the panel. According to this method one can bend such an upstanding flange by movably supporting a first flanging steel on a frame, providing a flanging steel drive on the frame and operatively connecting it to the first flanging steel. While the first flanging steel is in a retracted position, a metal panel workpiece is provided on the frame such that the first flanging steel extends through an opening in the workpiece. The first flanging steel is then moved radially outward from the retracted position toward a generally radially outward extended position where the first flanging steel overlies a first portion of an inside perimeter of the opening. As the first flanging steel is moved radially outward it engages an inner surface of an upper first portion of an upstanding workpiece flange that extends generally axially upwardly from around an inside perimeter of the opening in the workpiece. The flanging steel then bends the upper first portion of the flange radially outward such that a lateral bend line is formed along the flange where no breakline was present before bending.

Objects, features and advantages of this invention include the ability to bend an upstanding flange along one lateral side of an inside perimeter of an automotive window opening in a metal door panel where the flange has no pre-existing break line, the ability to do so while simultaneously bending the upstanding flange along an opposite lateral side of the window opening and along an top edge of the window where the sheet metal panel does have a pre-existing break line, and a robust construction that allows for producing multiple bends in upstanding flanges of successive panels in an assembly line process where the flanges have no pre-existing break lines to facilitate such bending.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION

Figure 1:
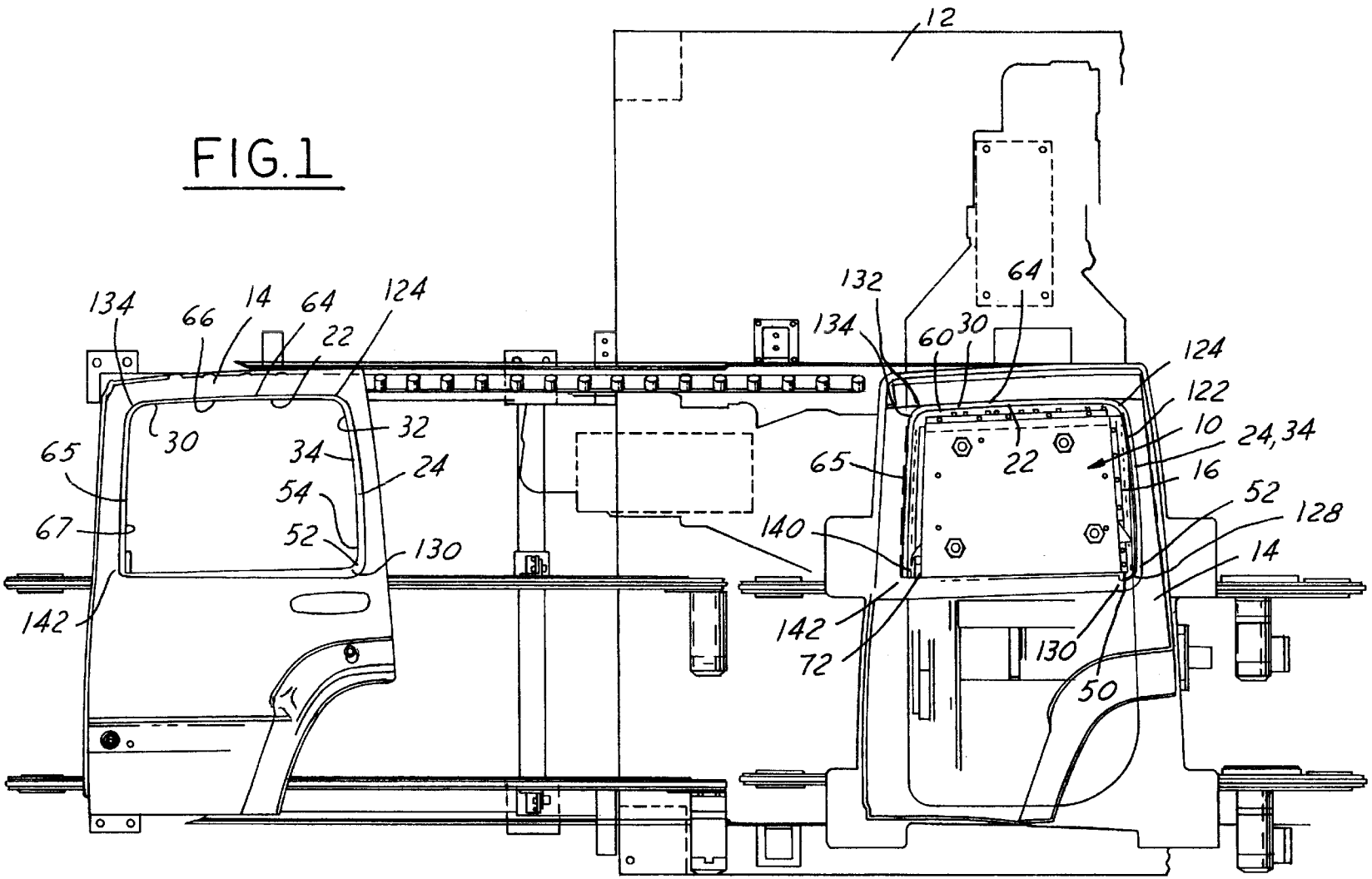
FIG. 1 is a top view of a conveyor system feeding door panels to a flange bending apparatus constructed according to the invention.

A flange bending apparatus 10 for bending an upstanding flange or rim on an inside perimeter of an opening in a metal panel workpiece, such as a window opening in an automotive door panel, is shown in the figures as part of an assembly line process. The flange bending apparatus 10 pre-bends upstanding window flanges to prepare them for a second machine in the assembly line to further bend the flange to a final desired position. The apparatus 10 includes a frame 12 designed to receive and support metal automotive door panels 14. A first flanging steel 16 is supported for motion along a motion plane between a generally radially inward retracted position shown in FIG. 3 and a generally radially outward extended position shown in FIGS. 5 and 8.

The apparatus 10 also includes a flanging steel drive 18 that includes an actuator 20 operatively connected to the first flanging steel 16. The actuator 20 reciprocally drives the first flanging steel 16 between the retracted and extended positions. In the retracted position the first flanging steel 16 is positioned to allow metal door panels 14 to be supported on the frame 12 with the first flanging steel 16 and a portion of the actuator 20 both extending upward through a window opening 22 in a door panel 14 supported on the frame 12. When in the extended position, the first flanging steel 16 overlies a front edge portion 24 of an inside perimeter of the window opening 22 of a door panel 14 supported on the frame 12.

The first flanging steel 16 is supported on a first steel mounting block 26 that is supported for reciprocal linear motion on slides 28. As the actuator 20 moves the first flanging steel 16 from the retracted toward the extended position, the first flanging steel 16 engages an upstanding flange, best shown at 30 in FIG. 8, that surrounds the window opening 22 of a door panel 14 supported on the frame 12. More specifically, the first flanging steel 16 engages an inner surface 32 of an upper front portion 34 of the upstanding window flange 30 that extends generally axially upwardly, relative to the motion plane, from around the inside perimeter of the opening 22 in the door panel 14. The first flanging steel 16 then bends the upper front portion 34 of the door panel flange 30 radially outward as the actuator 20 moves the first flanging steel 16 into the extended position. The frame 12 is constructed to support a door panel 14 in such a way that outward flanging steel motion bends only the upper front portion 34 of the door panel flange 30 radially outward so that a lateral bend line 36 is formed along the flange 30 where no breakline was present before bending.

Figure 6:
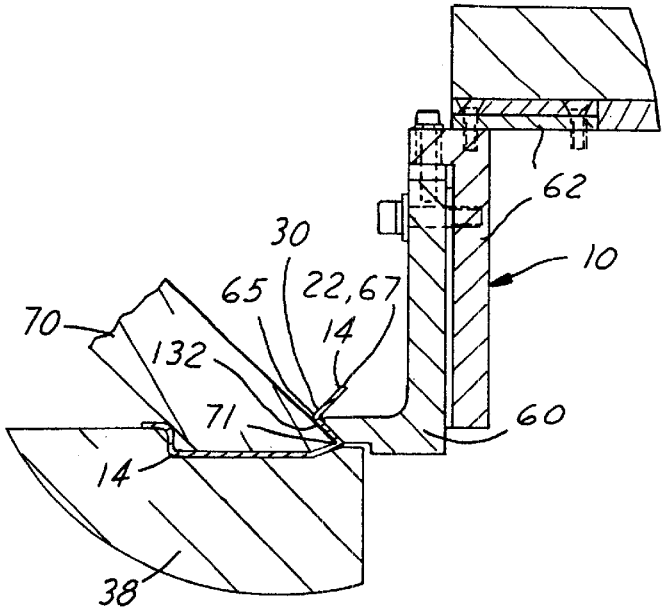
FIG. 6 is a partial cross-sectional side view of a third flanging steel and third steel mounting block of the apparatus taken along line 6—6 in FIG. 5.
Figure 7:
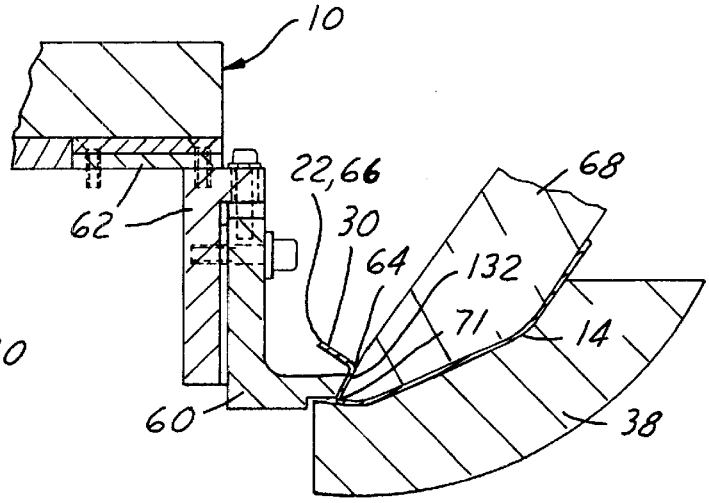
FIG. 7 is a partial cross-sectional side view of the third flanging steel and third steel mounting block of the apparatus taken along line 7—7 in FIG. 5.
Figure 8:
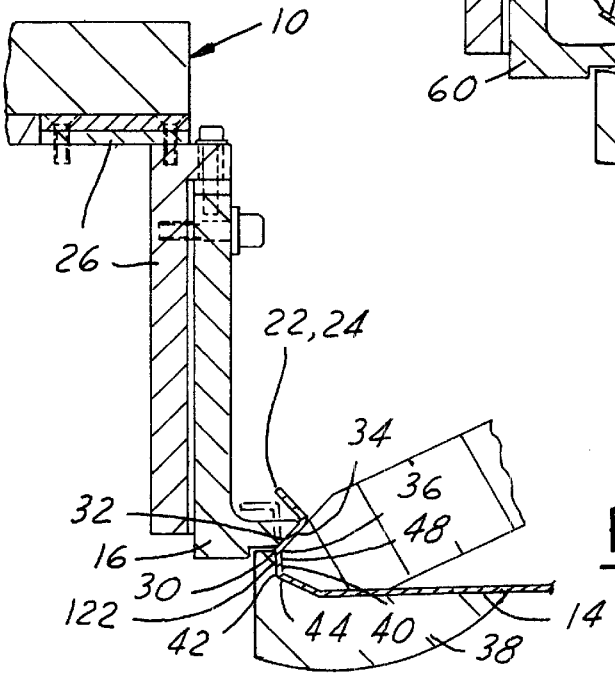
FIG. 8 is a partial cross-sectional side view of the first flanging steel and first steel mounting block of the apparatus taken along line 8—8 in FIG. 5.

As shown in FIGS. 6–8, the frame 12 includes a die ring 38 shaped to support at least the window opening 22 region of a metal door panel 14. The die ring 38 including an upstanding abutment surface 40 positioned to engage an inner surface 42 of a lower front portion 44 of the upstanding flange 30 below the bend line 36. The frame 12 further includes a front backup block 46 that engages an outer surface 48 of the lower front portion 44 of the upstanding flange 30 opposite the inner surface 42. As best shown in FIG. 8, the front backup block 46 compressively holds the lower front portion 44 of the upstanding flange 30 against the upstanding abutment surface 40 such that the portion of the upstanding flange 30 that the first steel 16 engages is prevented from bending below the bend line 36 when the actuator 20 drives the first steel 16 into the extended position.

A second flanging steel 50 is supported on the frame 12 for movement between a generally inward retracted position and a generally outward extended position. The second flanging steel 50 is operatively connected to or "slaved" off the first flanging steel 16 such that movement of the first flanging steel 16 to its extended position drives the second flanging steel 50 to its extended position shown in FIG. 5. Conversely, movement of the first flanging steel 16 to its retracted position drives the second flanging steel 50 to its retracted position shown in FIG. 3. As with the first flanging steel 16, the retracted position of the second flanging steel 50 allows a metal door panel 14 to be positioned and supported on the frame 12 with the second flanging steel 50 extending through a window opening 22 in the door panel 14.

The second flanging steel 50 overlies a bottom front corner edge portion 52 of the flange 30 defining the window opening 22 when the second flanging steel 50 is in the extended position. As with the first steel, the second flanging steel 50 is positioned and configured to engage the inner surface 32 of the upper front portion 34 of the upstanding door panel flange 30 and to aid the first steel 16 in bending the upper front portion 34 of the door panel flange 30 radially outward when the first steel 16 moves the second flanging steel 50 from its retracted to its extended position. The die ring 38 and the front backup block 46 support the upstanding flange 30 in such a way that outward motion of the first and second flanging steels 16, 50 bend only the upper front portion 34 of the door panel flange 30 radially outward so that the lateral bend line 36 is formed along the flange 30 where no breakline was present before bending.

A third flanging steel 60 is supported on a third steel mounting block 62 that is supported for reciprocal linear motion on slides 63 supported on the frame 12. The third flanging steel 60 is supported on the frame 12 for movement along a motion plane between a generally radially inward retracted position shown in FIG. 3 and a generally radially outward extended position shown in FIGS. 5, 6 and 7. The actuator 20 is operatively connected to the third steel mounting block 62 and is configured to reciprocally drive the third block 62 and steel 60 between the retracted and extended positions.

While the first and third steel mounting blocks 26, 62, are driven independently by the main crank as described above, they are also operatively interconnected in such a way as to allow the first and third steels 16, 60, in cooperation with the slaved motion of the second and fourth steels, to engage and overlie the entire flange 30 defining the inside perimeter of the window opening 22, yet still retract to a position where the door panel can be raised and lowered over the machine. More specifically, the interconnection between the first and third steel mounting blocks 26, 62 allows the steels 16, 50, 60, 72 to cooperatively engage and overlie the entire front, bottom front corner, top, back and bottom back corner edge portions 34, 52, 64, 65, 142 of the upstanding flange 30. The interconnection arrangement that allows this to occur includes mounting of the slides 28 that support the first steel mounting block 26 as described above. Rather than being supported on a fixed element, such as the frame 12, the slides 28 are supported on the third steel mounting block 62. This, combined with the motion effects produced by the dwell portion 120 in the second cam slot 108, causes the first flanging steel 16 to move in a curvilinear path with respect to the frame 12 and door panel 14. This curvilinear path carries the first flanging steel 16 in a direction that is, at first, generally parallel to the front edge portion 24 of the window opening, and then in an outward radial direction that is generally perpendicular to the front edge portion 24 of the window opening.

As with the first and second flanging steels, the retracted position of the third flanging steel 60 allows the metal door panel 14 to be placed on the frame 12 with the third flanging steel 60 extending through the window opening 22 in the door panel 14. The third flanging steel 60 overlies top and back edge portions 64, 65 of an inside perimeter of the window opening 22 of the door panel 14 when the third flanging steel 60 is in the extended position. The third flanging steel 60 is positioned and configured to engage respective inner surfaces 66, 67 of the top and back edge portions 64, 65 of the upstanding door panel flange 30 of a door panel 14 supported on the frame 12 and to bend the top and back edge portions 64, 65 of the door panel flange 30 radially outward when the actuator 20 moves the third flanging steel 60 from the retracted to the extended position.

As best shown in FIGS. 6 and 7, top and rear backup blocks 68, 70 compressively hold down the door panel 14 immediately adjacent the respective top and back edge portions 64, 65 of the upstanding flange 30 such that the top and back edge portions 64, 65 of the upstanding flange 30 are bent at a pre-existing bend line 71 when the actuator 20 drives the third steel 60 into the extended position. The die ring 38 and the top and rear backup blocks 68, 70 cooperate to secure the window region of the door panel 14 in such a way that outward motion of the third flanging steel 60 bends the door panel flange 30 radially outward along the pre-existing lateral bend line 71.

Figure 2:
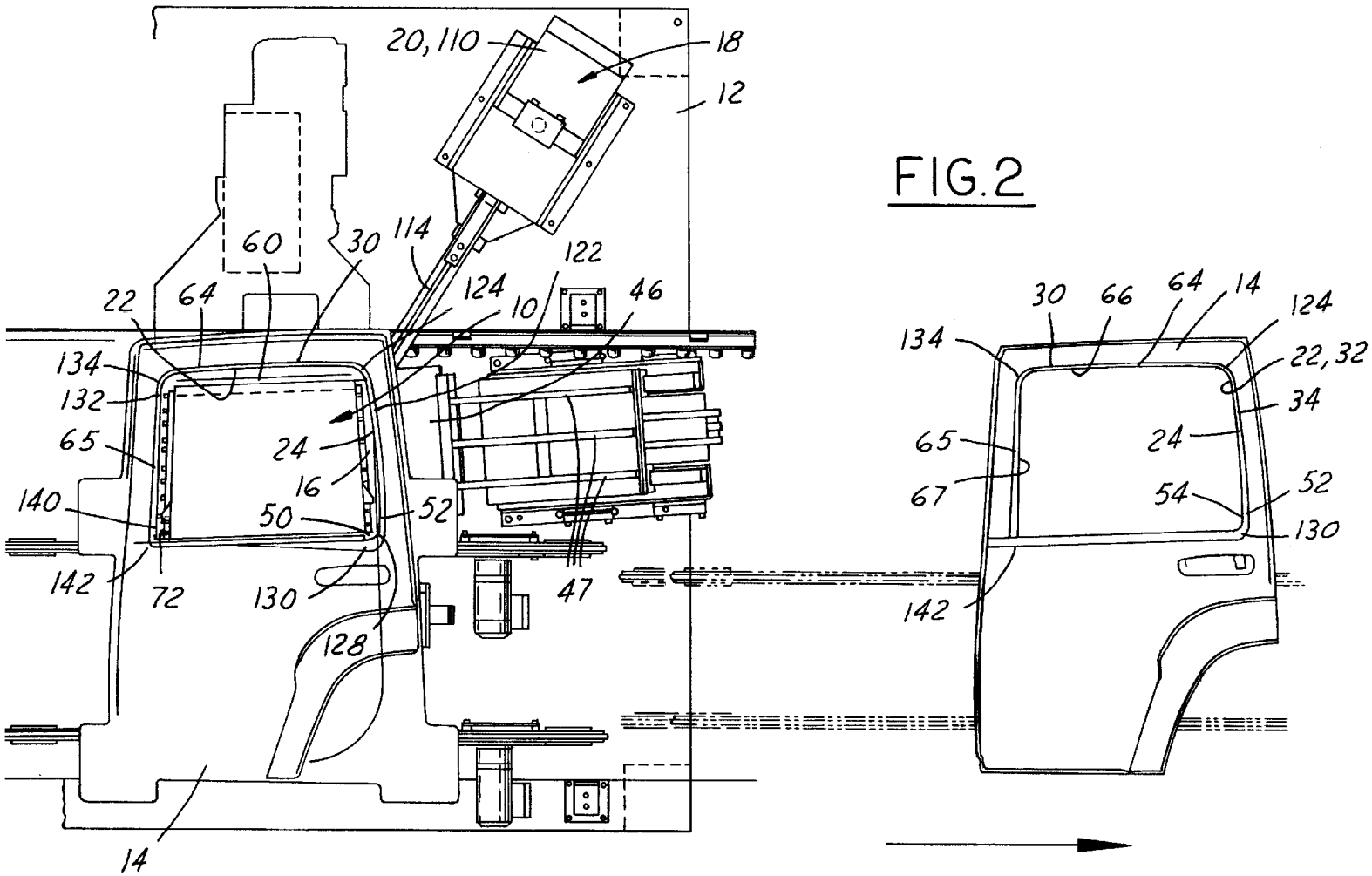
FIG. 2 is a top view of the conveyor system removing door panels from the flange bending apparatus of FIG. 1.
Figure 9:
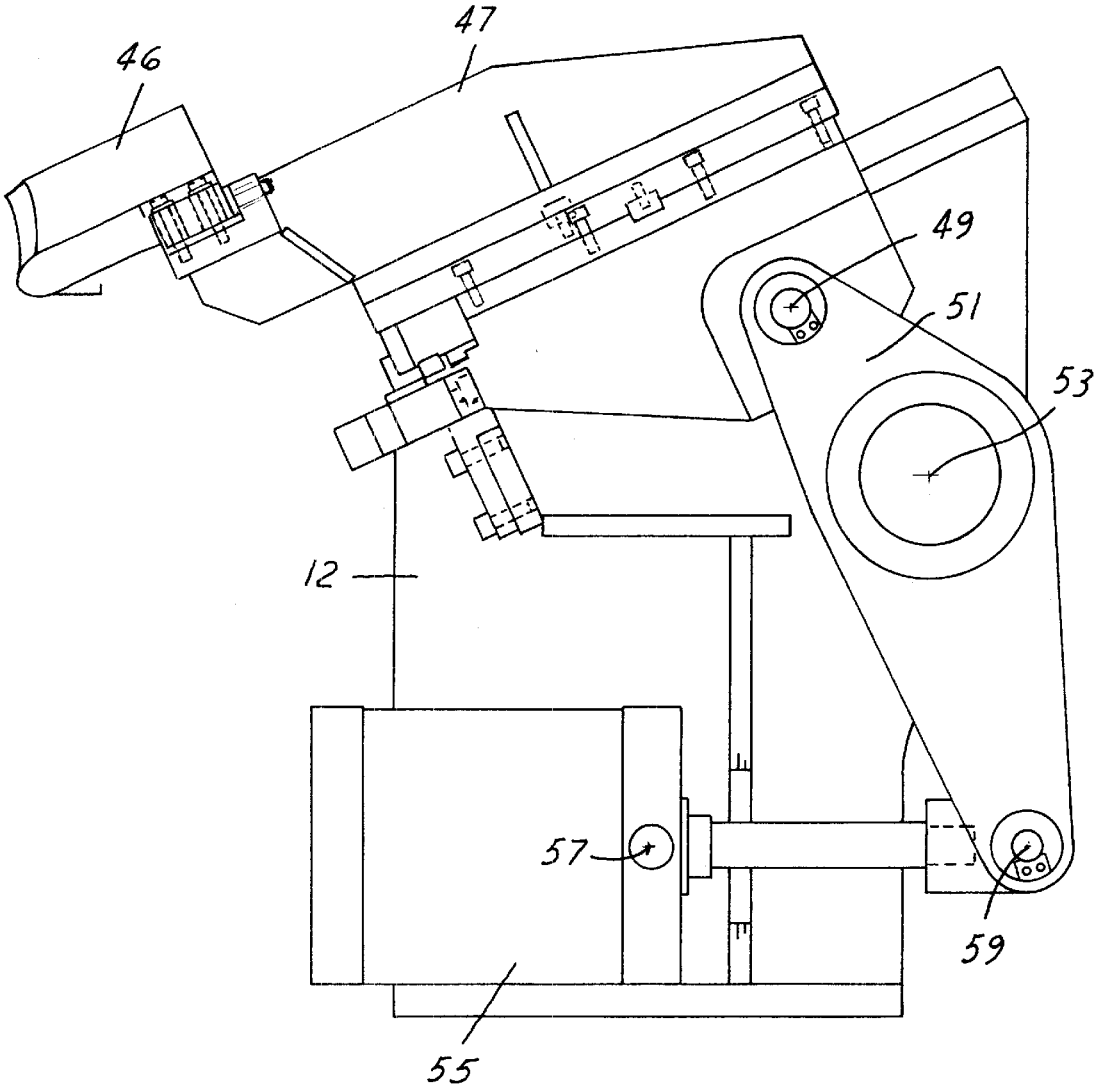
FIG. 9 is a side view of a front backup block and a front backup block drive system of the conveyor system and flange bending apparatus of FIG. 2.

The backup blocks 46, 68, 70 are independently supported for reciprocal linear motion on slides supported on the frame as is representatively shown for the front backup block 46 in FIG. 2. The backup blocks 46, 68, 70 are actuated between a generally radially outward retracted position and a generally radially inward extended position. As the three backup blocks 46, 68, 70 are similarly supported and driven, the following will describe on the front backup block 46 and its associated support and drive system. The front backup block 46 is shown in its inward extended position in FIGS. 2 and 9. As is best shown in FIG. 9, the front backup block 46 is supported on a support structure 47 and is connected via a cam slot connection 49 to a lever arm 51. The lever arm 51 is journalled for rotation about a fixed lever arm pivot 53 supported on the frame 12. An actuator that includes an air cylinder 55 drives the front backup block 46. The air cylinder 55 is connected between a fixed cylinder pivot point 57 on the frame 12 and a cylinder/lever arm pivot connection 59 on the lever arm 51 that is spaced from a lever arm pivot 53.

Figure 3:
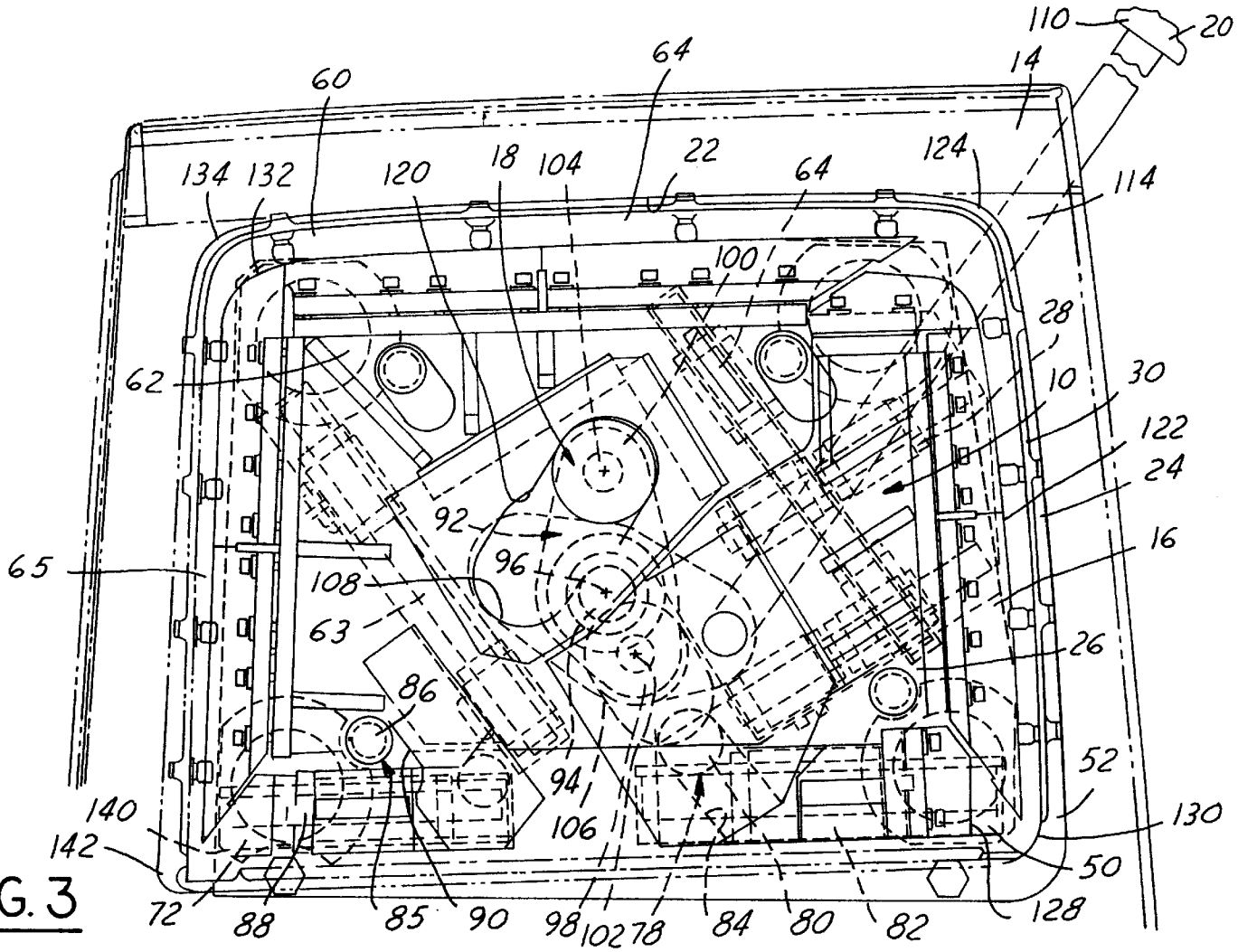
FIG. 3 is a top view of the window region of a door panel supported on the flange bending apparatus of FIG. 1 with four flanging steels of the apparatus shown in respective retracted positions.
Figure 4:
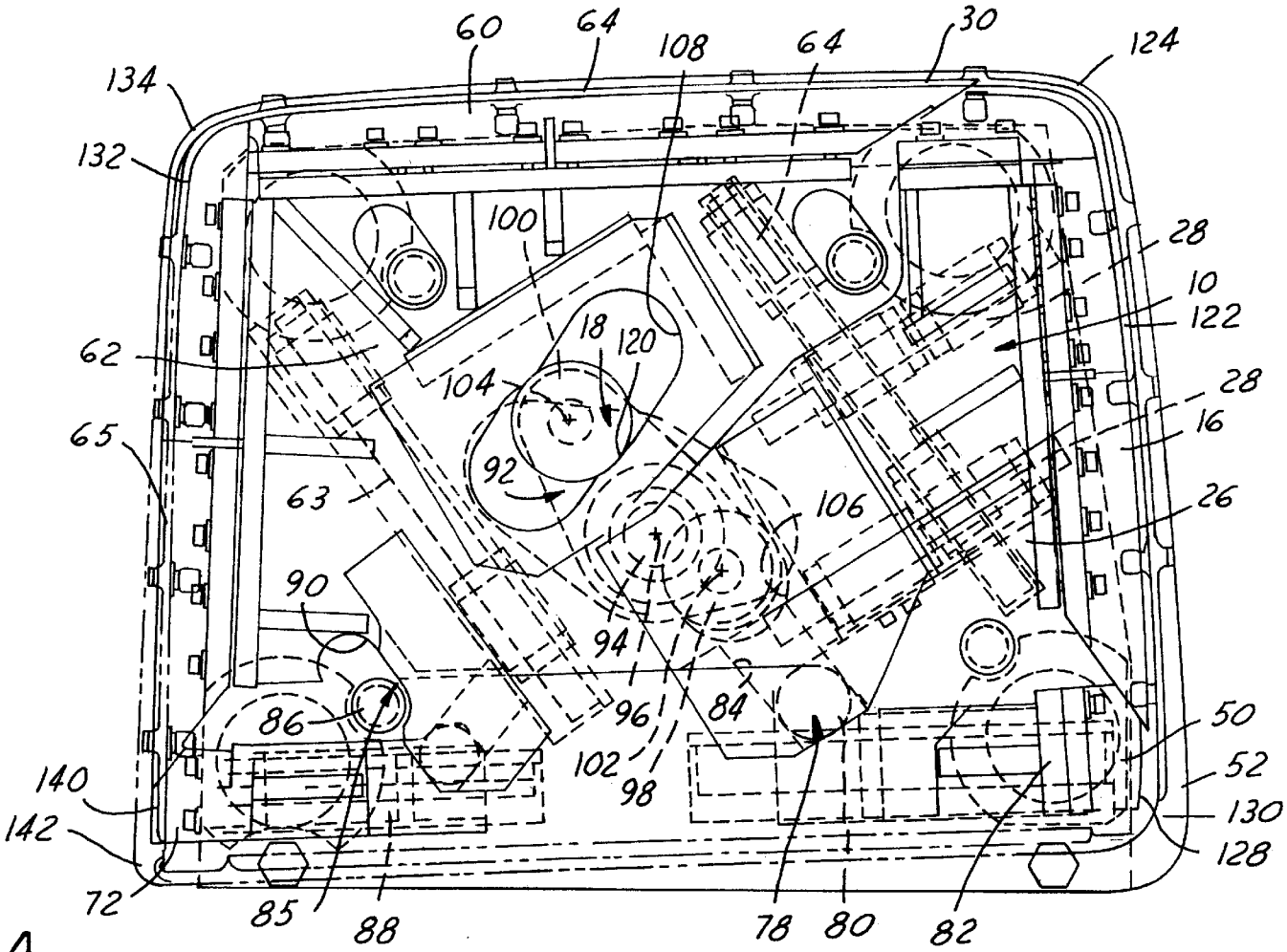
FIG. 4 is a top view of the flange bending apparatus of FIG. 1 with the four flanging steels of the apparatus shown midway between respective retracted and extended positions.
Figure 5:
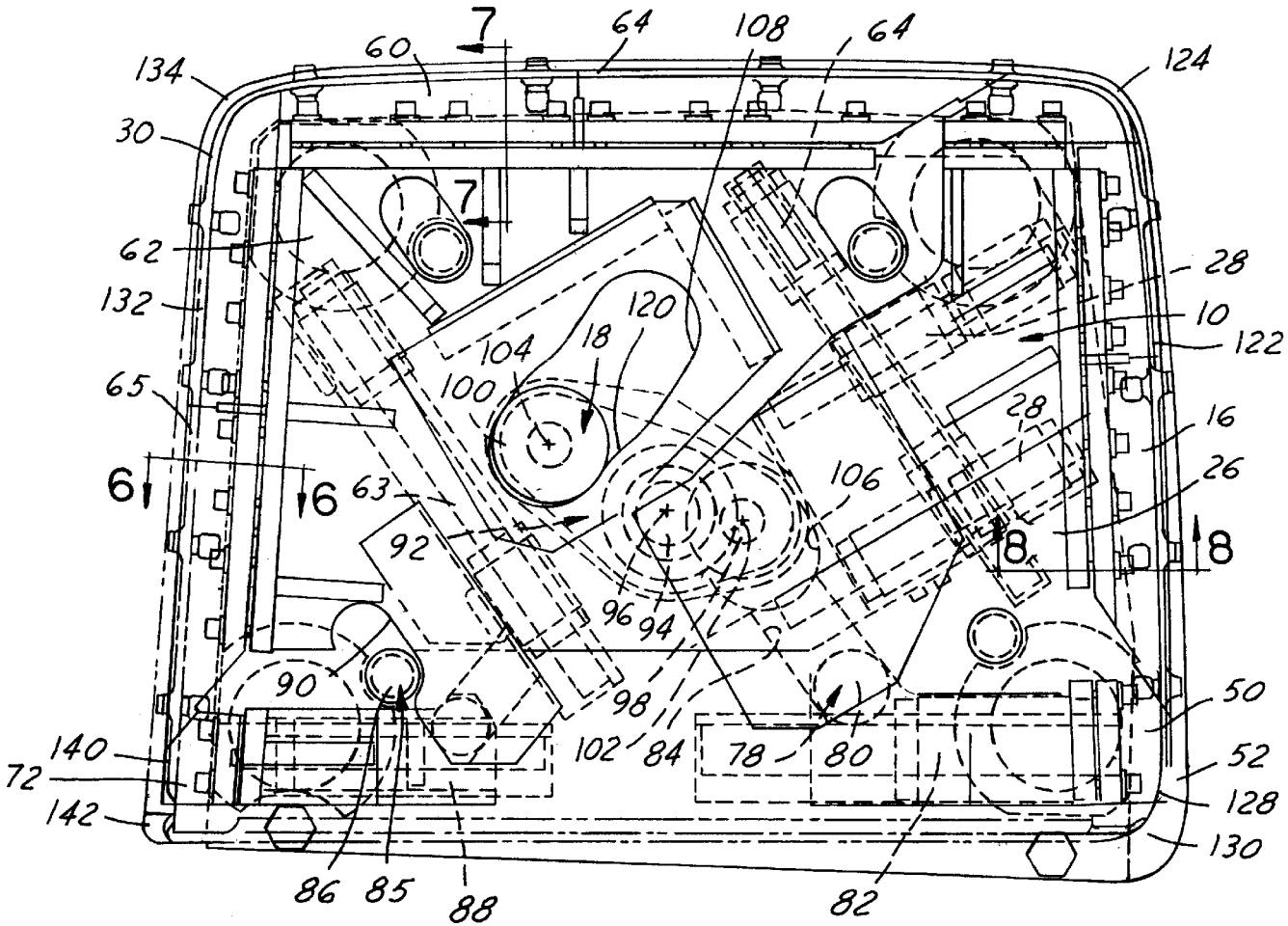
FIG. 5 is a top view of the flange bending apparatus of FIG. 1 with the four flanging steels of the apparatus shown in respective extended positions.

A fourth flanging steel 72 is supported on the frame 12 for movement between a generally inward retracted position shown in FIG. 3 and a generally outward extended position shown in FIG. 5. The fourth flanging steel 72 is "slaved" off the third flanging steel 60 just as the second flanging steel 50 is slaved off the first flanging steel 16. Movement of the third flanging steel 60 to its extended position drives the fourth flanging steel 72 to its extended position and movement of the third flanging steel 60 to its retracted position drives the fourth flanging steel 72 to its retracted position.

As with the other three steels, the retracted position of the fourth flanging steel 72 allows a metal door panel 14 to be placed on the frame 12 with the fourth flanging steel 72 extending through the window opening 22 in the door panel 14. The fourth flanging steel 72 overlies a bottom back corner edge portion 142 of the upstanding flange 30 defining the inside perimeter of the window opening 22 of a door panel when the fourth flanging steel 72 is in the extended position.

The fourth flanging steel 72 is positioned directly adjacent the third steel to cooperate with the third steel in engaging the inner surface 67 of the aft portion 65 of the upstanding door panel flange 30 and to bend the aft portion 65 of the door panel flange 30 radially outward when the actuator 20 moves the third flanging steel 60 from the retracted to the extended position. The rear backup block 70 compressively holds down the door panel 14 such that the fourth steel 72 bends the part of the upstanding flange 30 that it contacts at the existing bend line 71. Therefore, the die ring 38 and the rear backup block 70 support the window region of the door panel 14 in such a way that outward motion of the fourth flanging steel 72 bends the bottom back corner edge portion 142 the upstanding flange 30 radially outward along the pre-existing lateral bend line 71.

A first steel interconnect 78 operatively connects the first steel 16 to the second steel 50 and includes a first interconnect cam roller 80 supported on a second steel mounting block 82. The second steel mounting block 82 supports the second steel 50 for linear lateral reciprocal motion on the frame 12. The first steel interconnect 78 also includes a first interconnect cam slot 84 formed in the first steel mounting block 26. The first interconnect cam slot 84 in the first steel mounting block 26 is configured to receive the first interconnect cam roller 80 in rolling engagement. The motion of the first interconnect cam slot 84 drives the first interconnect cam roller 80 and the second steel mounting block 82 and steel 50 between their retracted and extended positions as the first flanging steel 16 moves between its retracted and extended positions.

A second steel interconnect 85 operatively connects the third steel 60 to the fourth steel 72. The second steel interconnect 85 includes a second interconnect cam roller 86 supported for rotation on a fourth steel mounting block 88. The fourth steel mounting block 88 supports the fourth steel 72 for linear lateral reciprocal motion on the frame 12. The second steel interconnect 85 also includes a second interconnect cam slot 90 formed in the third steel mounting block 62 that is shaped to receive the second interconnect cam roller 86 in rolling engagement. Motion of the second interconnect cam slot 90 in the third steel mounting block 62 drives the second interconnect cam roller 86 and the fourth steel mounting block 88 and steel 72 between their retracted and extended positions as the third flanging steel 60 moves between its retracted and extended positions.

The flanging steel drive 18 includes a main crank 92 journalled for rotation about a fixed pivot 94 supported on the frame 12. A main crank axis 96 of the main crank 92 extends longitudinally through the pivot 94. First and second main crank 92 cam rollers 98, 100 are rotatably supported on the main crank 92. The first and second main crank 92 cam rollers 98, 100 have respective axes 102, 104 disposed parallel to and spaced from the main crank axis 96 and from each other.

A first cam slot 106 is formed in the first steel mounting block 26 that supports the first steel 16. The first cam slot 106 is configured to receive the first main crank 92 cam roller 98 in rolling engagement. Reciprocal counterclockwise and clockwise pivoting motion of the main crank 92 causes the first main crank 92 cam roller 98 to drive the first steel mounting block 26 and steel 16 between their respective extended and retracted positions as the first main crank 92 cam roller 98 rolls along the cam slot 106 in the first steel mounting block 26.

A second cam slot 108 is formed in the third steel mounting block 62 and is shaped to receive the second main crank cam roller 102 in rolling engagement. Reciprocal counterclockwise and clockwise pivoting motion of the main crank 92 causes the second main crank 92 cam roller 102 to drive the third steel mounting block 62 and the third steel 60 between their respective extended and retracted positions as the first main crank cam roller 100 rolls along the second cam slot 108.

The actuator 20 of the flanging steel drive 18 includes an air cylinder 110 that is connected between the frame 12 and a pivot point 112 on the crank 92. The pivot point 112 is spaced from the crank axis 96. The air cylinder 110 includes an actuator rod 114 that is pivotally connected to the crank 92.

The second cam slot 108 is shaped to include a dwell portion 120 located approximately midway along the slot 108. The dwell portion 120 is oriented tangentially to the path of the first main crank cam roller 100 so that when the first main crank cam roller 100 passes through the dwell portion 120, it imparts no motion to the third steel 60. As a result, neither the third nor the fourth steels move as the first main crank cam roller 100 is moving through the dwell portion 120 of the second cam slot 108.

The first steel 16 has an L-shaped plan view configuration having an outer edge surface 122 that generally complements the shape of a top-front corner 124 of the window opening 22 of a door panel 14 supported on the frame 12. The outer edge surface 122 of the first steel 16 also complements the shape of most of the front portion 24 of the window opening 22. The second steel 50 has an outer edge surface 128 that is shaped to complement the shape of a lower-front corner 130 of the window opening 22.

The third steel 60 has an L-shaped plan-view configuration having an outer edge 132 that generally complements the shape of an top-back corner 134 of the window opening 22 of a door panel 14 supported on the frame 12. The outer edge surface 132 of the third steel 60 also complements most of the top edge 64 and back edge 65 of the window opening 22. The fourth steel 72 has an outer edge surface 140 that is shaped to complement the shape of a lower-back corner 142 of the window opening 22.

In practice, a conveyor moves each door panel 14 to a position where the window opening 22 of the door panel 14 is vertically aligned with the four steels 16, 50, 60, 72 of the flange bending apparatus 10. Either the steels 16, 50, 60, 72, actuator 20 and die ring 38 are then raised or the door panel 14 is then lowered so that the steels extend through the window opening 22 and the window opening 22 region of the door panel 14 rests on the die ring 38. The backup blocks 46, 68, 70 are then advanced from their retracted positions to their engaged positions against respective outer surfaces 48, 56 of the upstanding flange 30.

The front backup block 46 engages and holds the outer surface 48 of the lower front portion 44 of the upstanding flange 30 against the upstanding abutment surface 40 and below the bend line 36. The top and rear backup blocks 68, 70 engage and hold down the door panel 14 along and adjacent lateral bend lines 71 defining lower ends of the top and back edges 64, 65 of the upstanding flange 30. The four flanging steels 16, 50, 60, 72 are then moved from their retracted to their extended positions by causing the steel drive 18 to move the four steels outward.

The actuator cylinder 110 of the steel drive 18 pivots the main crank 92 which causes the first and second main crank cam rollers 98, 100 to roll along their respective cam slots 106, 108 in the first and third steel mounting blocks 26, 62, driving the mounting blocks 26, 62, 82, 88 from their retracted to their extended positions. As the first and third steel mounting blocks 26, 62 move to their extended positions, the motion of the first interconnect cam slot 84 in the first steel mounting block 26 drives the first interconnect cam roller 80 and, therefore, the second steel mounting block 82 and steel to their extended positions. Likewise, the motion of the second interconnect cam slot 90 in the second steel mounting block 82 drives the second interconnect cam roller 86 and, therefore, the fourth steel mounting block 88 and steel 72 to their extended positions.

The outward motion of the first and second flanging steels 16, 50, after engaging the inner surface 32 of the upper front portion 34 of the upstanding door panel flange 30, bends the upper front portion 34 of the flange 30 radially outward where no bend line previously existed along the front edge 126 of the window opening 22. Similarly, the outward motion of the third and fourth flanging steels 60, 72, after engaging inner surfaces of third and fourth portions of the upstanding flange 30, bends the third and fourth portions of the flange 30 radially outward along a pre-existing bend line 71 along top and back edges 64, 65 of the upstanding flange 30 defining the window opening 22.

This description is intended to illustrate certain embodiments of the invention rather than to limit the invention. Therefore, it uses descriptive rather than limiting words. Obviously, it's possible to modify this invention from what the description teaches. Within the scope of the claims, one may practice the invention other than as described.

What is claimed is:

1. A flange bending apparatus for bending an upstanding flange along an inside perimeter of an opening in a panel, the apparatus comprising:

a frame configured to support a metal panel workpiece;

a first flanging steel supported on the frame for movement between a generally radially inward retracted position and a generally radially outward extended position;

a flanging steel drive including an actuator operatively connected to the first flanging steel and configured to reciprocally drive the first flanging steel between the retracted and extended positions, the retracted position of the first flanging steel allowing a metal panel workpiece to be positioned on the frame with the flanging steel extending through an opening in a workpiece supported on the frame, the first flanging steel overlying a first portion of an inside perimeter of the opening when the first flanging steel is in the extended position, the first flanging steel being positioned and configured to engage an inner surface of an upper first portion of an upstanding workpiece flange that extends generally axially upwardly from around the inside perimeter of the opening in the workpiece and to bend the upper first portion of the workpiece flange radially outward when the actuator moves the first flanging steel from the retracted to the extended position, the first flanging steel and frame being configured to bend the upper first portion of the workpiece flange radially outward such that a lateral bend line is formed along the flange where no breakline was present before bending;

a second flanging steel is supported on the frame for movement between a generally radially inward retracted position and a generally radially outward extended position;

a first steel interconnect operatively connects the first steel to the second steel and includes a cam roller rotatably connected to one of the first and second steels;

a cam slot is formed in the other of the first and second steels and is configured to receive the cam roller in rolling engagement such that motion of the cam roller in the cam slot drives the second steel between the retracted and extended positions as the first flanging steel moves between its retracted and extended positions;

the retracted position of the second flanging steel allows the metal panel workpiece to be positioned on the frame with the second flanging steel extending through an opening in the workpiece; and the second flanging steel is positioned and configured to engage an inner surface of an upper portion of the upstanding workpiece flange and to bend the upper portion of the workpiece flange radially outward when the first flanging steel moves the second flanging steel from the retracted to the extended position such that a lateral bend line is formed along the flange where no breakline was present before bending.

2. A flange bending apparatus as defined in claim 1 in which:

the frame includes a die ring configured to support a metal panel workpiece having an upstanding flange extending generally axially upwardly from around the inside perimeter of an opening in the workpiece;

the die ring includes an upstanding abutment surface positioned to engage an inner surface of a lower first portion of the upstanding flange below the bend line; and the frame further includes a backup block configured to engage an outer surface of the lower first portion of the upstanding flange and to compressively hold the lower first portion of the upstanding flange against the upstanding abutment surface such that the upstanding flange is prevented from bending below the bend line when the actuator drives the first steel into the extended position.

3. A flange bending apparatus for bending an upstanding flange along an inside perimeter of an opening in a panel, the apparatus comprising:

a frame configured to support a metal panel workpiece;

a first flanging steel supported on the frame for movement between a generally radially inward retracted position and a generally radially outward extended position;

a flanging steel drive including an actuator operatively connected to the first flanging steel and configured to reciprocally drive the first flanging steel between the retracted and extended positions, the retracted position of the first flanging steel allowing a metal panel workpiece to be positioned on the frame with the flanging steel extending through an opening in a workpiece supported on the frame, the first flanging steel overlying a first portion of an inside perimeter of the opening when the first flanging steel is in the extended position, the first flanging steel being positioned and configured to engage an inner surface of an upper first portion of an upstanding workpiece flange that extends generally axially upwardly from around the inside perimeter of the opening in the workpiece and to bend the upper first portion of the workpiece flange radially outward when the actuator moves the first flanging steel from the retracted to the extended position;

the first flanging steel and frame being configured to bend the upper first portion of the workpiece flange radially outward such that a lateral bend line is formed along the flange where no breakline was present before bending;

a second flanging steel is supported on the frame for movement between a generally radially inward retracted position and a generally radially outward extended position;

the second flanging steel is operatively connected to the first flanging steel such that movement of the first flanging steel to its extended position drives the second flanging steel to its extended position;

the retracted position of the second flanging steel allows the metal panel workpiece to be positioned on the frame with the second flanging steel extending through an opening in the workpiece;

the second flanging steel overlies a second portion of an inside perimeter of the opening when the second flanging steel is in the extended position;

a third flanging steel is supported on the frame for movement between a generally radially inward retracted position and a generally radially outward extended position;

the actuator is operatively connected to the third flanging steel and is configured to reciprocally drive the third flanging steel between the retracted and extended positions;

the retracted position of the third flanging steel allows a metal panel workpiece to be positioned on the frame with the third flanging steel extending through an opening in the workpiece;

the third flanging steel overlies a portion of the inside perimeter of the opening in the workpiece when the third flanging steel is in the extended position;

the third flanging steel is positioned and configured to engage an inner surface of a portion of the upstanding workpiece flange and to bend that portion of the workpiece flange radially outward when the actuator moves the third flanging steel from the retracted to the extended position; and the third flanging steel and frame are configured to bend the portion of the workpiece flange radially outward along a pre-formed lateral breakline in the flange.

4. A flange bending apparatus as defined in claim 3 in which the first and third steels are configured and movably supported to:

engage and overlie top and generally opposed front and back edge portions of a flange defining at least a portion of the inside perimeter of an opening in a panel; and move to a retracted position where the panel can be raised and lowered over the steels.

5. A flange bending apparatus as defined in claim 4 in which:

a fourth flanging steel is supported on the frame for movement between a generally radially inward retracted position and a generally radially outward extended position;

the fourth flanging steel is operatively connected to the third flanging steel such that movement of the third flanging steel to its extended position drives the fourth flanging steel to its extended position;

the retracted position of the fourth flanging steel allows a metal panel workpiece to be positioned on the frame with the fourth flanging steel extending through an opening in the workpiece; and the fourth flanging steel overlies a portion of an inside perimeter of the opening when the fourth flanging steel is in the extended position.

6. A flange bending apparatus as defined in claim 5 in which the first and third steels cooperate with second and fourth steels to:

engage and overlie generally opposed top and bottom edge portions of a flange defining at least a portion of the inside perimeter of an opening in a panel;

engage and overlie generally opposed front and back edge portions of the flange; and move to respective retracted positions where the panel can be raised and lowered over the steels.

7. A flange bending apparatus as defined in claim 6 in which the fourth flanging steel is positioned and configured to engage an inner surface of a portion of the upstanding workpiece flange and to bend that portion of the workpiece flange radially outward when the third flanging steel moves the fourth flanging steel from the retracted to the extended position.

8. A flange bending apparatus as defined in claim 7 in which the fourth flanging steel and frame are configured to bend a portion of the workpiece flange radially outward along a pre-formed lateral breakline in the flange.

9. A flange bending apparatus as defined in claim 8 in which:

a second steel interconnect operatively connects the third steel to the fourth steel and includes a cam roller rotatably connected to one of the third and fourth steels; and a cam slot is formed in the other of the third and fourth steels and is configured to receive the cam roller in rolling engagement such that motion of the roller in the cam slot drives the fourth steel between its retracted and extended positions as the third flanging steel moves between its retracted and extended positions.

10. A flange bending apparatus as defined in claim 3 in which the drive includes:

a main crank supported for pivotal motion on the frame about a main crank axis, first and second main crank cam rollers rotatably supported on the main crank and having respective first and second main crank cam axes spaced from the main crank axis and from each other, a first cam slot formed in a first steel mounting block that supports the first steel and is slidably supported on the frame, the first cam slot being configured to receive the first main crank cam roller in rolling engagement such that reciprocal pivoting motion of the main crank causes the first main crank cam roller to drive the first steel mounting block and steel between their respective extended and retracted positions, a second cam slot formed in a third steel mounting block that supports the third steel and is slidably supported on the frame, the second cam slot being configured to receive the second main crank cam roller in rolling engagement such that reciprocal pivoting motion of the main crank causes the second main crank cam roller to drive the third steel mounting block and steel between their respective extended and retracted positions.

11. A flange bending apparatus as defined in claim 10 in which the actuator includes a drive cylinder connected between the frame and a pivot point on the crank spaced from the crank axis.

12. A flange bending apparatus as defined in claim 10 in which the second clam slot includes a dwell portion that causes the third steel to hesitate momentarily between the retracted and extended positions.

13. A flange bending apparatus as defined in claim 9 in which the first steel has an L-shaped configuration that generally complements the shape of:

a top-front corner of a window opening in a metal door panel workpiece supported on the frame; and a portion of a front edge of the window opening that extends from the top-front corner.

14. A flange bending apparatus as defined in claim 13 in which the second steel is configured to complement the shape of a lower-front corner of the window opening of a metal door panel workpiece supported on the frame.

15. A flange bending apparatus as defined in claim 14 in which the third steel has an L-shaped configuration that generally complements the shape of:

a top-back corner of a window opening in a metal door panel workpiece supported on the frame;

a portion of a top edge of the opening that extends laterally from the top-back corner; and a back edge of the opening that extends downwardly from the top-back corner.

16. A flange bending apparatus as defined in claim 15 in which the fourth steel is configured to complement the shape of a lower-back corner of a window opening in a metal door panel workpiece supported on the frame.

17. A flange bending apparatus for bending an upstanding flange along an inside perimeter of an opening in a panel, the apparatus comprising:

a frame configured to support a metal panel workpiece;

a first flanging steel supported on the frame for movement between a generally radially inward retracted position and a generally radially outward extended position;

a main crank supported for pivotal motion on the frame about a main crank axis;

a first main crank cam roller rotatably supported on the main crank and having a first main crank cam axis spaced from the main crank axis;

a cam slot formed in a first steel mounting block that supports the first steel and is slidably supported on the frame;

the cam slot is configured to receive the first main crank cam roller in rolling engagement such that reciprocal pivoting motion of the main crank causes the first main crank cam roller to drive the first steel mounting block and steel between the respective extended and retracted positions;

the retracted position of the first flanging steel allowing a metal panel workpiece to be positioned on the frame with the flanging steel extending through an opening in a workpiece supported on the frame, the first flanging steel overlying a first portion of an inside perimeter of the opening when the first flanging steel is in the extended position, the first flanging steel being positioned and configured to engage an inner surface of an upper first portion of an upstanding workpiece flange that extends generally axially upwardly from around the inside perimeter of the opening in the workpiece and to bend the upper first portion of the workpiece flange radially outward when the actuator moves the first flanging steel from the retracted to the extended position; and the first flanging steel and frame being configured to bend the upper first portion of the workpiece flange radially outward such that a lateral bend line is formed along the flange where no breakline was present before bending.

18. A method for bending an upstanding flange along an inside perimeter of an opening in a panel, the method including the steps of providing a frame and movably supporting a first flanging steel on the frame;

providing a first steel mounting block that supports the first steel and is slidably supported on the frame and includes a cam slot;

providing a main crank supported for pivotal motion on the frame about a main crank axis;

providing a first main crank cam roller rotatably supported on the main crank and having a first main crank cam axis spaced from the main crank axis, the cam roller being received in the cam slot in rolling engagement;

positioning a metal panel workpiece on the frame while the first flanging steel is in a retracted position such that the first flanging steel extends through an opening in the workpiece; and driving the first steel mounting block radially outward by pivoting the main crank and causing the first main crank cam roller to roll along the cam slot in the first steel mounting block to move the first flanging steel radially outward from the retracted position toward a generally radially outward extended position where the first flanging steel will overlie a first portion of an inside perimeter of the opening; and to continue to move the first flanging steel radially outward until it engages an upper portion of an upstanding workpiece flange that extends generally axially upwardly from around an inside perimeter of the opening in the workpiece and bends the upper portion of the flange radially outward such that a lateral bend line is formed along the flange where no breakline was present before bending.

19. The method of claim 18 in which:

the step of providing a frame and movably supporting a first flanging steel on the frame includes providing a die ring configured to support a metal panel workpiece having an upstanding flange extending generally axially upwardly from around the inside perimeter of an opening in the workpiece, the die ring including an upstanding abutment surface, the step of providing the frame further includes movably supporting a backup block on the frame, the step of positioning a workpiece on the frame includes positioning the workpiece such that the upstanding abutment surface engages an inner surface of a lower portion of the upstanding flange below the bend line, and, after the step of positioning the workpiece, including the additional step of causing the backup block to engage an outer surface of the lower portion of the upstanding flange and to hold the lower portion of the upstanding flange against the upstanding abutment surface such that the upstanding flange is prevented from bending below the bend line when the actuator drives the first steel into the extended position.

* * * * *